US012031236B2

(12) United States Patent
Skinner et al.

(10) Patent No.: US 12,031,236 B2
(45) Date of Patent: Jul. 9, 2024

(54) DEVICE FOR POLYMER MATERIALS FABRICATION USING GAS FLOW AND ELECTROSTATIC FIELDS

(71) Applicants: Jack L. Skinner, Butte, MT (US); Emily A. Kooistra-Manning, Butte, MT (US); Jessica M. Andriolo, Butte, MT (US); Lane G. Huston, Butte, MT (US)

(72) Inventors: Jack L. Skinner, Butte, MT (US); Emily A. Kooistra-Manning, Butte, MT (US); Jessica M. Andriolo, Butte, MT (US); Lane G. Huston, Butte, MT (US)

(73) Assignee: Montana Technological University, Butte, MT (US)

( * ) Notice: Subject to any disclaimer, the term of this patent is extended or adjusted under 35 U.S.C. 154(b) by 30 days.

(21) Appl. No.: 17/614,540

(22) PCT Filed: May 30, 2020

(86) PCT No.: PCT/US2020/035478
§ 371 (c)(1),
(2) Date: Nov. 28, 2021

(87) PCT Pub. No.: WO2020/243684
PCT Pub. Date: Dec. 3, 2020

(65) Prior Publication Data

US 2022/0228296 A1 Jul. 21, 2022

Related U.S. Application Data

(60) Provisional application No. 62/854,508, filed on May 30, 2019.

(51) Int. Cl.
*D01D 5/00* (2006.01)
*D01F 1/08* (2006.01)
*D01F 1/10* (2006.01)

(52) U.S. Cl.
CPC ..... *D01D 5/0084* (2013.01); *D01D 5/0023* (2013.01); *D01D 5/003* (2013.01); *D01F 1/08* (2013.01); *D01F 1/10* (2013.01)

(58) Field of Classification Search
CPC .... D01D 5/0084; D01D 5/0023; D01D 5/003; D01D 5/0061; D01F 1/08; D01F 1/10
See application file for complete search history.

(56) References Cited

U.S. PATENT DOCUMENTS 7,012,342 B1 * 3/2006 Stamps ..... H02M 1/092 361/173
7,794,219 B2 * 9/2010 Dubson ..... D04H 1/728 425/7

(Continued)

FOREIGN PATENT DOCUMENTS

CN 101914815 A 12/2010
CN 107050525 A 8/2018

(Continued)

OTHER PUBLICATIONS

Extended European Search Report, dated Aug. 9, 2023.

*Primary Examiner* — Allison Bernstein
*Assistant Examiner* — Margaret B Hayes
(74) *Attorney, Agent, or Firm* — Mitchell S. W. Vap

(57) ABSTRACT

Electrospinning (ES) produces fibers with small cross-sections and high surface area, making them ideal for a multitude of applications. Structures produced using ES methods exhibit a high surface-to-volume ratio, tunable porosity, and controllable composition. ES involves the delivery of a liquid or solid polymer to a spinneret, whereby, an initiated electric field pulls the polymer into micro to nano-scale (Continued)

fibers. Due to the multitude of applications for which polymer fibers can be used, it is desirable to provide an efficient and portable ES device that allows on-demand deposition of polymer materials. The invention that is subject of this patent application is a portable ES device that allows ideal deposition on a substrate regardless of whether that substrate is attached to high voltage or grounded, and regardless of whether or not there is a charged or grounded substrate behind the desired deposition surface.

20 Claims, 10 Drawing Sheets

(56) References Cited

U.S. PATENT DOCUMENTS 8,508,368 B2 * 8/2013 Potyrailo ..... G06K 19/0717 235/385
9,101,860 B2 * 8/2015 Green ..... B01D 39/1623
2002/0084178 A1 * 7/2002 Dubson ..... D01D 5/18 422/131
2007/0042069 A1 * 2/2007 Armantrout ..... D01D 5/0061 425/72.2
2008/0110342 A1 * 5/2008 Ensor ..... D01D 5/0092 425/173
2011/0201242 A1 8/2011 Hur et al.
2013/0197663 A1 * 8/2013 MacEwan ..... D04H 1/728 623/23.72
2014/0159263 A1 * 6/2014 Lozano ..... D01D 5/18 425/8
2017/0239094 A1 * 8/2017 Dubson ..... A61F 13/00017
2019/0091167 A1 3/2019 Liu et al.

FOREIGN PATENT DOCUMENTS

CN 108441972 A 8/2018
CN 108588887 A 9/2018
JP 2010163715 A 7/2010
JP 2010163715 A 7/2013
KR 1020170036411 A 4/2017
WO 2009113290 A1 9/2009
WO WO-2014118585 A2 * 8/2014 ..... B05B 5/005

* cited by examiner

DEVICE FOR POLYMER MATERIALS FABRICATION USING GAS FLOW AND ELECTROSTATIC FIELDS

CROSS-REFERENCE TO RELATED APPLICATIONS

This application claims the benefit of U.S. Provisional Application No. 62/854,508 filed on May 30, 2019, the disclosure of which is hereby incorporated by reference in its entirety to provide continuity of disclosure.

STATEMENT REGHARDING FEDERALLY SPONSORED RESEARCH OR DEVELOPMENT

Not Applicable This invention was made with government support under Cooperative Agreement # W911NF-15-2-0020 awarded by Army Research Laboratory. The government has certain rights in the invention.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

Electrospinning (ES) produces fibers with small cross-sections and high surface area, making them ideal for a multitude of applications. Structures produced using ES methods exhibit a high surface-to-volume ratio, tunable porosity, and controllable composition. ES is of interest to the technical community in areas involving novel ES methods and materials including enhanced filtration [D. Aussawasathien, et al., *Journal of Membrane Science,* 2008, R. Gopal et al., *Journal of Membrane Science,* 2007. K. M. Yun, et al., *Chemical Engineering Science,* 2007. X. H. Qin, et al., *Journal of Applied Polymer Science,* 2006] augmented biomedical tissue regeneration [D. Liang, et al., *Advanced Drug Reviews,* 2007, Kim et al., *Biomaterials,* 2003], and advanced fabrication of liquid crystal polarizers [Y. Y F, et al., *Advanced Materials,* 2007]. Although ES was initially described by Formhals in a series of patents as an experimental setup for the production of polymer filaments using electrostatic force. The first patent filed by Formhals in 1934 on ES was issued for the production of textile yarns, with a process consisting of a movable thread collecting device that gathered threads in a stretched condition. He was granted related patents in 1938, 1939, and 1940[K. J. Pawlowski, et al., *Materials Research Society Symposia,* 2004]. ES was first observed in 1897 by Rayleigh, with related electrospraying studied in detail in 1914 and a patent issued to Antonin Formhals in 1934 [J. Zeleny, *Physical Reviews,* 1914, A. Formhals, U.S. Pat. No. 1,975,504A, 1934]. In 1969, the published work of Taylor set the foundation for ES [G. Taylor, *Proceedings* "Electrically driven jets," *Proceedings of the Royal Society of London A: Mathematical, Physical, and Engineering Sciences,* 1969].

Traditional ES is performed on a table top and involves the delivery of a liquid polymer to a spinneret (sometimes referred to as a capillary or needle or dispensor) [I. S. Chronakis, *Journal of Materials Processing Technology,* 2005, Z. M. Huang, et al. *Journal of Composites Science,* 2003, J. Doshi et al., *Journal of Electrostatics,* 1995] that is held at a high voltage relative to a collection plate [J. L. Skinner et al., *Proceedings of SPIE—The International Society for Optical Engineering,* 2015]. Polymer is pumped to the tip of the spinneret, and electric charge is initiated in the collection plate. The initiated voltage creates an electrostatic force that pulls polymer from spinneret to electrode deposition surface. An initial short region (microns to millimeters) where the fiber is essentially straight is called the stable region. At the point where lateral perturbations cause transverse fiber velocities, the instability region starts. The instability region consists of polymer fiber moving in a whipping motion from the stable region toward the collection plate, while solvent evaporates off the polymer jet. Polymer fibers are then deposited onto the charged collection surface. Fiber size, quality, and dimensions of the deposited mat depend largely on solution flow rate, supplied electric current, figure land fluid surface tension [S. V. Fridrikh, et al., *Physical Reviews Letters*, V. Beachley et al., *Materials Science Engineering C,* 2009, A. Koski, et al., *Materials Letters,* 2004].

There have been several attempts to provide an ES device that is transportable and could be used to deposit polymer materials on non-conductive substrates such as skin. A transportable electrospinner would allow on-demand deposition of polymer materials. For example, a soldier in the field could carry an electrospinner and provide on-site deposition of blood clotting bandages or antibacterial wound coatings, and doctors could carry electrospinners to remote locations to treat the same such ailments. Other application examples include depositing polymer materials with photo-converting dopants to create light-energy-harvesting surfaces, electrically conductive polymer composite fibers deposited as-needed wires in the field, or protective and preservative coatings on food. Transportable electrospinners demonstrated in the past, however, still require an electrode (connected to voltage or grounded) be placed behind the substrate to be deposited on. For example, a hand is placed in between the ES spinneret and charged collection surface, thereby collecting polymer fibers or droplets onto the hand as they move from spinneret toward charged surface. The drawbacks for such a setup include: (1) the hand or other uncharged object placed between the spinneret and collection surface is still exposed to the electric field created in between the spinneret and charged collection surface, (2) the mere requirement of a charged surface or object behind the un-charged surface desired for deposition, complicates and limits the applications of the system.

Depending on the patent referred to, the portable ES device described herein differs in various ways. However, the primary mechanism that differentiates previous portable ES devices from the device presented here, is that the present device has no need for an electrically conductive or grounded deposition surface or an electrically conductive or grounded surface be placed behind the desired, non-charged deposition surface. While the desire of a portable ES device is to be able to deposit onto any surface regardless of charge, this capability has not been demonstrated in previous devices without charging or grounding the surface to be deposited onto, or requiring the uncharged surface be placed into an electric field with the charged or grounded surface placed behind it. Therefore, the portable electrospinner described is substantially superior to previously patented devices and actually demonstrates the intended purpose of a portable ES device. Examples of patents describing a portable electrospinner include United States patent application publication number US20170239094A1 filed in 2017, U.S. patent number U.S. Pat. No. 7,794,219 B2 granted in 2010, and international patent number WO210/059127 A1 granted in 2010. In patent application publication number US20170239094A1 FIG. 1, the conductive portion 110 is located on the handle 120, which is attached to the collection surface by a conductive wire 165 for directed deposition onto the deposition surface 160. In patent number U.S. Pat. No. 7,794.219 B2 FIG. 2, dispenser 22 is kept under a positive polarity potential while both electrodes 28 and object 32 are grounded. In international patent WO210/059127 A1 FIG. 1, a grounded electrode for contacting a surface onto which fibers are deposited is used, hence still requiring a conductive deposition substrate.

BRIEF SUMMARY OF THE INVENTION

The invention herein is portable ES device that allows deposition directly onto surfaces that may or may not carry charge. The invention also does not require there be a charged or grounded surface behind the desired deposition surface. Using the portable ES device described, the substrate to be deposited onto is not placed within the electrostatic field during ES, nor is required to be supplied with a voltage or grounded in order for polymer to be deposited onto the surface. Alternatively, the portable ES device contains a spinneret (supplied with voltage or grounded), as well as an isolated ring electrode (supplied with voltage or grounded), and equipped with laminar airflow to force fibers onto the desired substrate beyond both electrodes. The ring electrode can also be a non-isolated electrode located inside of the device barrel. The ES device described herein can deposit onto virtually any non-charged, non-grounded substrate.

In the literature, there are many examples where traditional, tabletop ES fabrication was used to make biomedical materials. The portable ES device described herein allows these materials to be deposited directly into wound sites, onto implants, and onto tissues or organs. Such uses of the device prevent contamination by handling and decrease time to treatment. By using antibiotic doped polymers, the portable ES device can deposit onto non-conductive surfaces and dissolve to release antibiotics to prevent bacterial growth. The portable ES device could also be used to deposit pH sensing materials for early detection of impending infection.

Distinguishing capabilities of the portable ES device subject of this application include the ability to deposit onto any conductive or non-conductive substrate, the ability to be moved by hand to coat complex surfaces evenly, and the ability electrospin conductive materials reliably. In a traditional ES unit, ES conductive polymers results in an electric circuit that connects the conductive spinneret, through the conductive polymer being electrospun, to the conductive deposition substrate. This connected electric circuit results in arcing and unpredictable material deposition. In the portable ES device described herein, the electric field is completely encased in the device barrel, and because conductive polymer fibers do not make contact with the ring electrode, prevents any artifact from a connected electrical circuit.

According to another feature of the portable ES device that is subject of this application, the ES device can comprise a "T-shaped" embodiment where fibers to be deposited are directed perpendicularly from the electrostatic field by airflow means. This embodiment further reduces potential electrostatic field exposure of the surface or substrate receiving the deposition. Furthermore, this embodiment reduces electrode fouling and the necessity to clean electrodes during use.

According to another feature of the portable ES device that is subject of this application, the ES device further comprises a thermal system, which provides capability for use of dry or solid polymer to be melted prior to entry into the portable ES system in addition to the use of solvent-dissolved polymers. The portable ES device can be plugged in or battery operated and has quick-connect components that can be assembled or disassembled easily for device maintenance and preparation.

The portable ES device described herein is comprised of the following components:

(1) Battery powered or plugged in airflow means for control over fiber placement onto a charged or non-charged surface outside of the device barrel.
(2) Airflow connect system that centers the spinneret in the airflow stream and connects airflow means to the rest of the system.
(3) Device barrel, which encapsulates the spinneret, which is either connected to high voltage or is grounded.
(4) A conductive, enclosed spinneret that is connected to high voltage or ground and is the port of entry for polymer into the system.
(5) Polymer is delivered into the spinneret by way of a mechanically-powered pump system.
(6) A conductive electrode, which is placed near the end of the device barrel and can be positioned within, on the edge of, or outside of the device barrel. Said conductive electrode is preferably comprised of a ring electrode.
(7) A thermal system comprising a controller and heating elements to allow the option of using solid instead of solvent-dissolved polymer in the system. The thermal system melts solid polymers real-time as they enter the spinneret and move through the barrel of the portable ES system.
(8) A power supply means used to supply the system with high voltage. Said power supply means can comprise an EMCO CB 101 device that converts low DC voltage to high DC, a 12 V battery, and a 5V signal controller to vary potential output.
(9) The portable ES device further comprises quick-connect components that can be assembled and disassembled easily and rapidly for device maintenance and preparation.
(10) The ES device can be further comprised of an optional crossflow embodiment where the crossflow system comprises an electrostatic field directing polymer materials toward a conductive electrode before being re-directed by a perpendicular airflow stream onto a non-charged or grounded substrate located perpendicular to the spinneret.

DETAILED DESCRIPTION OF THE INVENTION

Figure 1:
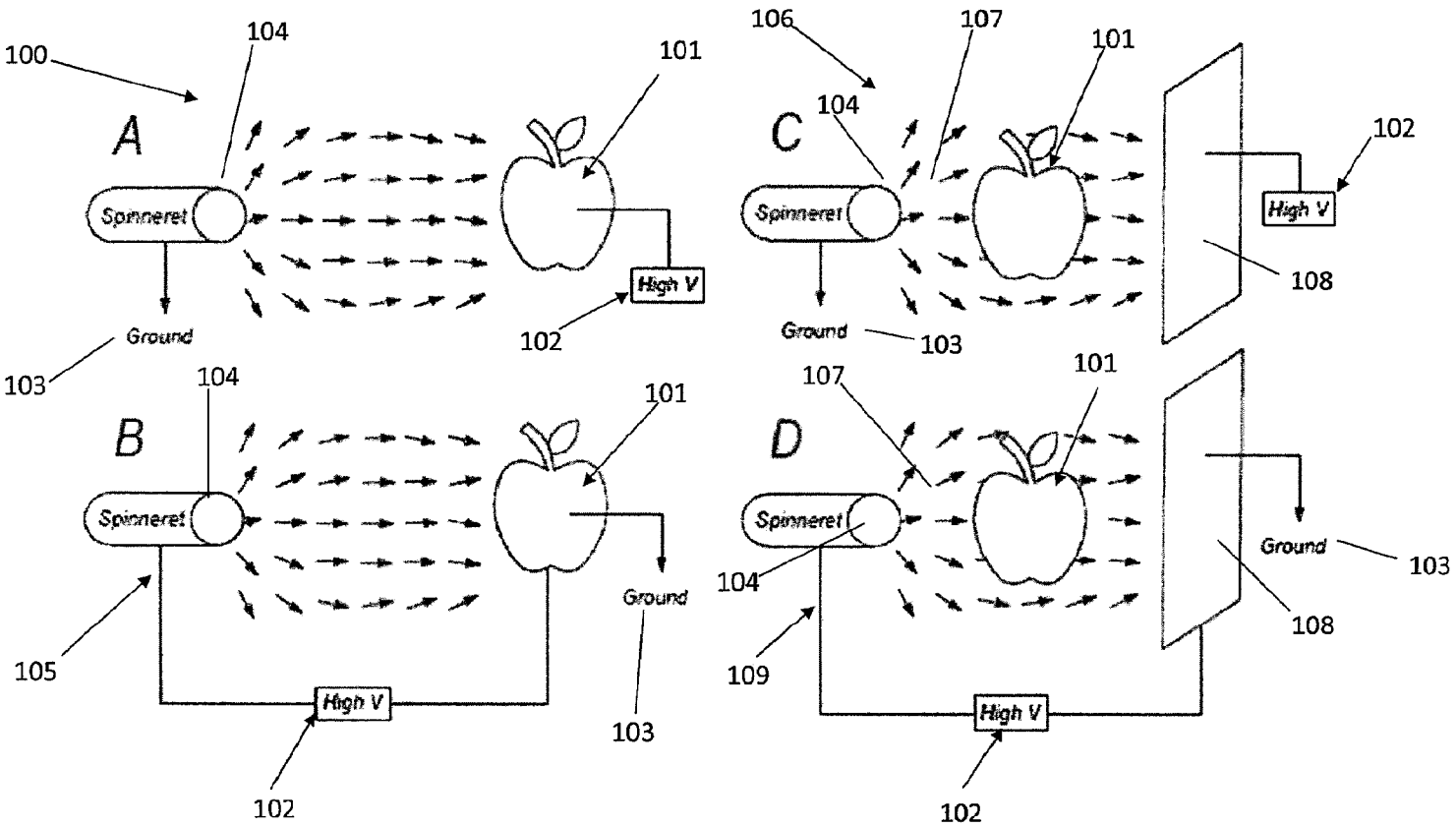
FIG. 1 (Prior Art)
FIG. 1 Conceptual depiction of portable ES devices in the prior art, which utilize a system where a ground or high-voltage substrate or a ground or high-voltage surface behind a non-charged substrate is required. A Portable ES set up that includes a non-charged substrate that must be delivered a high voltage signal to pull polymer from a grounded spinneret tip to substrate. B Portable ES set up that includes a non-charged substrate that must be grounded to pull polymer from charged spinneret tip to substrate. C Portable ES set up that includes a non-charged substrate that must be placed in the electrostatic field between the grounded spinneret and a surface that is supplied with high voltage. D Portable ES set up that includes a non-charged substrate that must be placed in the electrostatic field between the charged spinneret and a surface that is grounded.

Portable ES devices in the prior art, which utilized a system where a ground or high-voltage substrate or a ground or high-voltage surface behind a non-charged substrate is required are depicted in FIG. 1. FIG. 1A shows a Portable ES set up 100 that includes a non-charged substrate 101 that must be delivered a high voltage signal 102 to pull polymer from a grounded 103 spinneret tip 104 to the substrate 101. FIG. 1B shows a portable ES set up 105 that includes a non-charged substrate 101 that must be grounded 103 to pull polymer from high voltage 102 charged spinneret tip 104 to substrate 101. FIG. 1C depicts a Portable ES set up 106 that includes a non-charged substrate 101 that must be placed in the electrostatic field 107 between the grounded 103 spinneret 104 and a surface 108 that is supplied with high voltage 102. FIG. 1D depicts a Portable ES set up 109 that includes a non-charged substrate 101 that must be placed in the electrostatic field 107 between the high voltage charged 102 spinneret 104 and a surface 108 that is grounded 103.

The invention described herein is a portable ES device that allows deposition directly onto surfaces that may or may not carry charge. FIG. 2, FIG. 7-10. The portable ES device 200 described herein allows direct deposition onto charged or non-charged surfaces or substrates 201 that exist outside the electric field 202 created by the device 200. While the electrostatic force encased within the portable ES device provides the force necessary to create polymer fibers or droplets from liquified polymer, it does not require the deposition surface or substrate 201 to be charged or grounded, nor does it require a charged or grounded surface 108 be placed behind the desired deposition surface or substrate 201. Using airflow means 203, the described portable ES device 200 forces polymer materials outside of the device and onto charged or non-charged surfaces or substrates 201.

Figure 2:
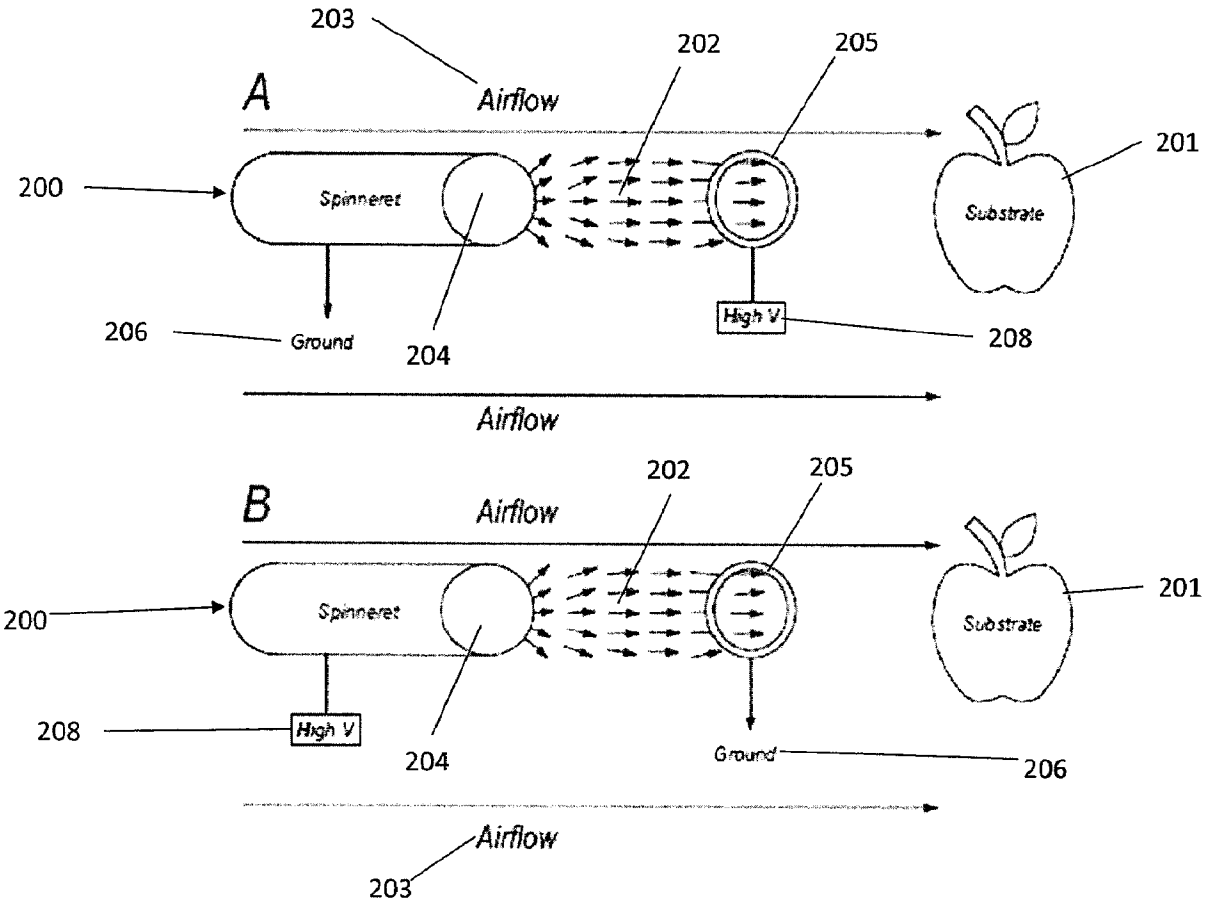
FIG. 2 Depiction of the portable ES device described herein. Electrostatic force pulls polymer from the spinneret toward a ring electrode, at which point, airflow overcomes the electrostatic force and directs polymer through the center of the ring electrode and onto a deposition surface or substrate beyond the end of the ES device, regardless of the charge of the deposition surface or substrate. A. One embodiment of the portable ES device, in which, a grounded spinneret and high voltage conductive ring electrode are used to deposit onto a non-conductive substrate. B. A second embodiment of the portable ES device, in which, a spinneret connected to high voltage and a grounded ring electrode are used to deposit onto a non-conductive substrate.
Figure 7:
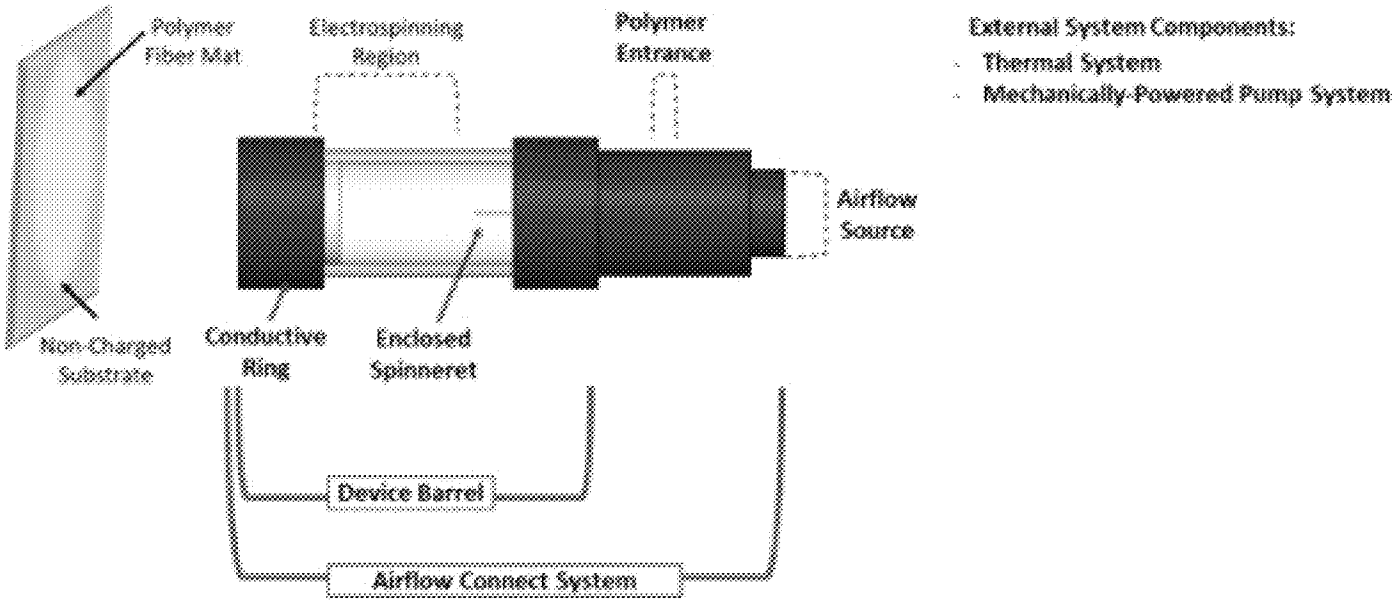
FIG. 7 Solid Works model of the portable ES device. During ES, pre-dissolved or melted solid polymer are delivered to the spinneret by mechanical force. Due to the charge or grounded state of the spinneret and conductive ring, an electrostatic force pulls polymer from spinneret tip towards the conductive ring. Airflow delivered to the system forces polymer materials through the ring center and away from the ring, onto a charged or non-charged substrate beyond the device.
Figure 8:
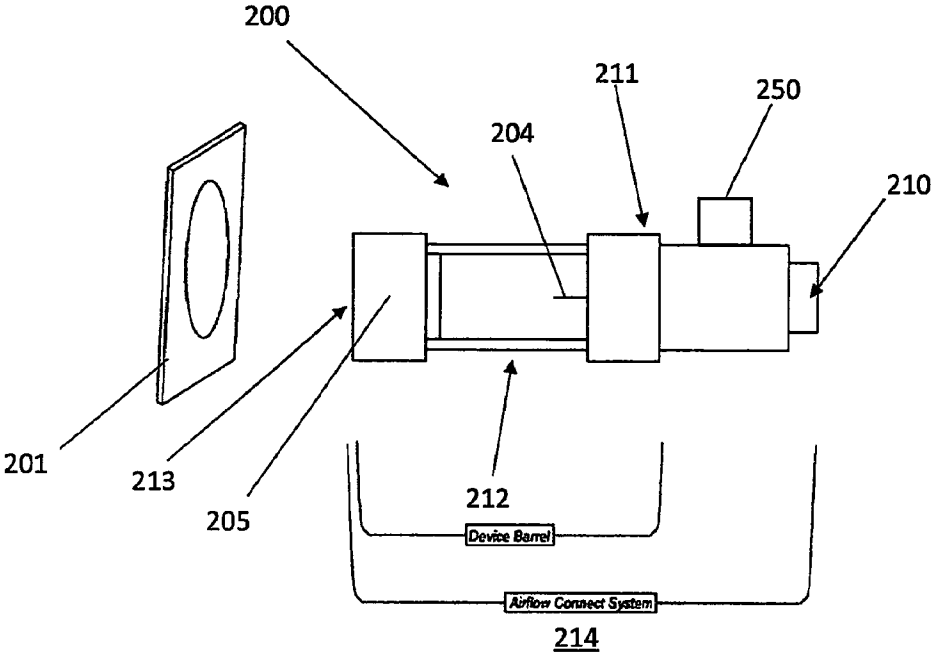
FIG. 8 Plan view of the portable ES device. During ES, pre-dissolved or melted solid polymer are delivered to the spinneret by mechanical force. Due to the charge or grounded state of the spinneret and conductive ring, an electrostatic force pulls polymer from spinneret tip towards the conductive ring. Airflow delivered to the system guides polymer materials away from the ring and through the ring center, onto a charged or non-charged substrate beyond the device.

As depicted in FIGS. 2, 7 and 8, electrostatic force pulls polymer from the spinneret 204 toward a ring electrode 205, at which point, airflow 203 comprised of airflow means 210 connected to a first end 211 of the barrel 212 of the device overcomes the electrostatic force and directs polymer through the center of the ring electrode 205 and onto a deposition surface or substrate 201 beyond the second end 213 of the portable ES device barrel 212, regardless of the charge of the deposition surface or substrate 201. This system does not require the substrate 201 be exposed to the electric field 202, thereby allowing for direct deposition onto living things without presenting a shock hazard. Furthermore, the deposition surface or substrate is not required to be grounded. In one embodiment of the portable ES device 200, shown in FIG. 2A, a grounded 206 spinneret 204 and high voltage 208 conductive ring electrode 205 are used to deposit onto a non-conductive substrate 201. FIG. 2B depicts another embodiment of the portable ES device 200, wherein a spinneret 204 connected to high voltage 208 and a grounded 206 ring electrode 205 are used to deposit onto a non-conductive substrate 201.

The portable ES device described herein is comprised of the following components:

(1) Battery powered or plugged in airflow means 210 for control over fiber placement onto a charged or non-charged surface 201 outside of the device barrel 212.

(2) Airflow connect system 214 that centers the spinneret 204 in the airflow stream and connects airflow means 210 to the rest of the system.

(3) Device barrel 212, which encapsulates the spinneret 204, which is either connected to high voltage 208 or is grounded 206.

(4) A conductive, enclosed spinneret 204 that is connected to high voltage 208 or ground 206 and is the port of entry for polymer into the system.

(5) Polymer is delivered into the spinneret 204 by way of a mechanically-powered means 220. Said mechanically-powered means 220 are preferably comprised of a pump system. Said mechanically-powered means can be further comprised of a syringe.

(6) A conductive electrode, preferably comprised of a ring electrode 205, which is placed near the second end 213 of the device barrel 212 and can be positioned within, on the edge of, or outside of the device barrel 212. Positioning said conductive electrode on the outside of said barrel 212 has the added advantage of completely isolating said conductive electrode from the electrospun material being deposited.

(7) A thermal system 250 comprising a controller and heating means to allow the option of using solid instead of solvent-dissolved polymer in the system. The thermal system 250 melts solid polymers real-time as they enter the spinneret 204 and move through the barrel 212 of the portable ES system 200.

(8) A power supply means used to supply the system with high voltage 208. Said power supply means can comprise an EMCO CB 101 device that converts low DC voltage to high DC, a 12 V battery, and a 5V signal controller to vary potential output.

(9) The portable ES device 200 further comprises quick-connect components that can be assembled and disassembled easily and rapidly for device maintenance and preparation.

Figure 9:
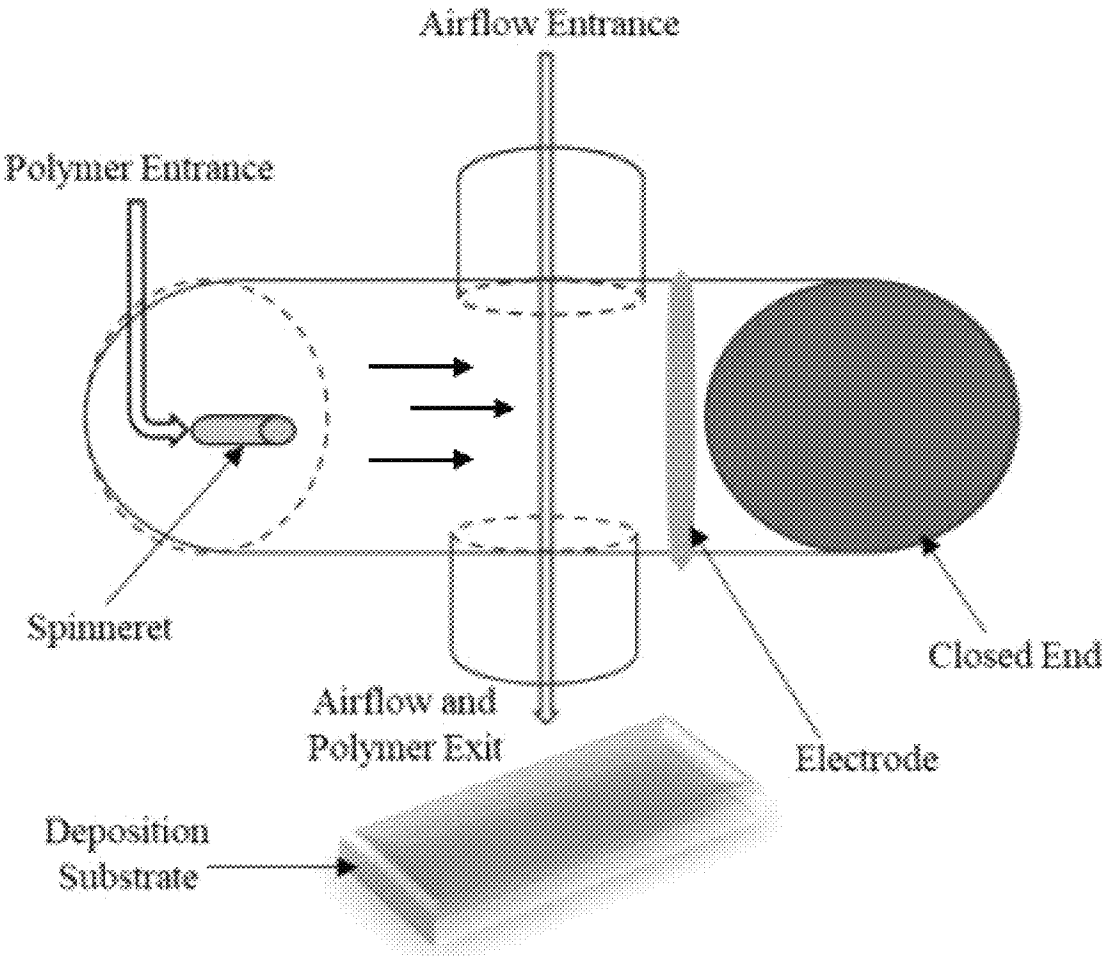
FIG. 9 Depiction of the crossflow embodiment of the portable ES device. In the crossflow system, electrostatic force directs polymer materials toward an electrode before being re-directed by a perpendicular airflow stream onto a charged or non-charged substrate located perpendicular to the spinneret and electrostatic field and outside of the barrel of the device.
Figure 10:
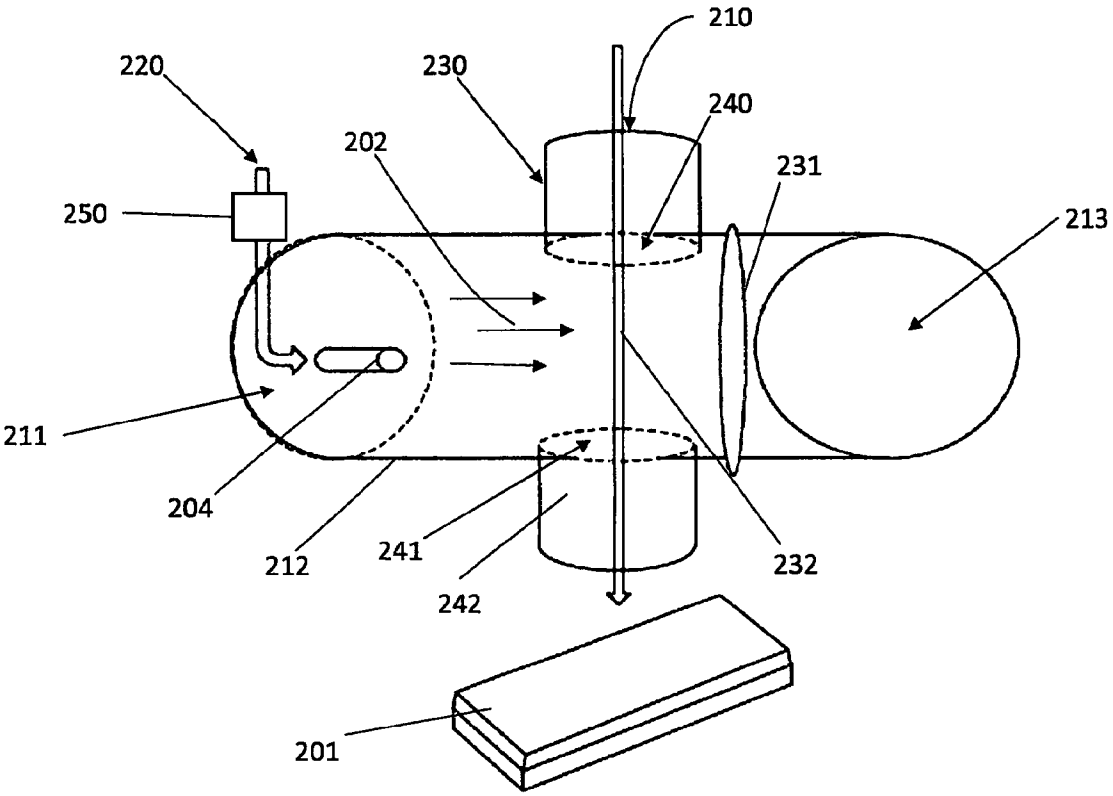
FIG. 10 Plan view showing the crossflow embodiment of the portable ES device. In the crossflow system, electrostatic force directs polymer materials toward an electrode before being re-directed by a perpendicular airflow stream onto a charged or non-charged substrate located perpendicular to the spinneret and electrostatic field and outside of the barrel of the device.

(10) The ES device 200 can be further comprised of an optional crossflow embodiment 230 depicted in FIGS. 9 and 10, where the crossflow system comprises an electrostatic field 202 directing polymer materials toward a conductive electrode 231 before being redirected by a perpendicular airflow stream 232 onto a non-charged or grounded substrate 201 located perpendicular to the spinneret 204. Said conductive electrode 231 can be located within the device barrel 212 or on the outside of said device barrel, which has the added advantage of completely isolating said conductive electrode from the electrospun material to be deposited. Said conductive electrode 231 can be further comprised of a ring electrode 205. In this embodiment, the system is further comprised of a first perpendicular opening 240 of said device barrel 212, where said airflow means 210 is connected to direct said perpendicular airflow stream 232 through the device barrel 212 perpendicular to said electrostatic field 202. Said airflow stream 232 then exits the device barrel 212 through a second perpendicular opening 241 of said device barrel 212. Said second perpendicular opening can be selectively fitted with a perpendicular barrel 242, through which electrospun fibers are deposited onto said surface or substrate 201. Said perpendicular barrel 242 can be shaped and sized in any manner to accommodate different application sizes, thicknesses, etc. This embodiment further reduces potential electrostatic field exposure of the surface or substrate receiving the deposition. Furthermore, this embodiment reduces electrode fouling and the necessity to clean electrodes during use.

The portable ES device 200 described herein has dramatically reduced size as compared to a typical tabletop electrospinner. This allows the portable ES device to be easily handled by hand and allows the user to manually coat surfaces evenly. In a traditional ES unit, a complex structure such as a ball would be coated unevenly. However, the handheld, portable ES device 200 described herein can be maneuvered to evenly coat non-charged or charged surfaces 201 such as complex implants or wound beds.

Figure 3:
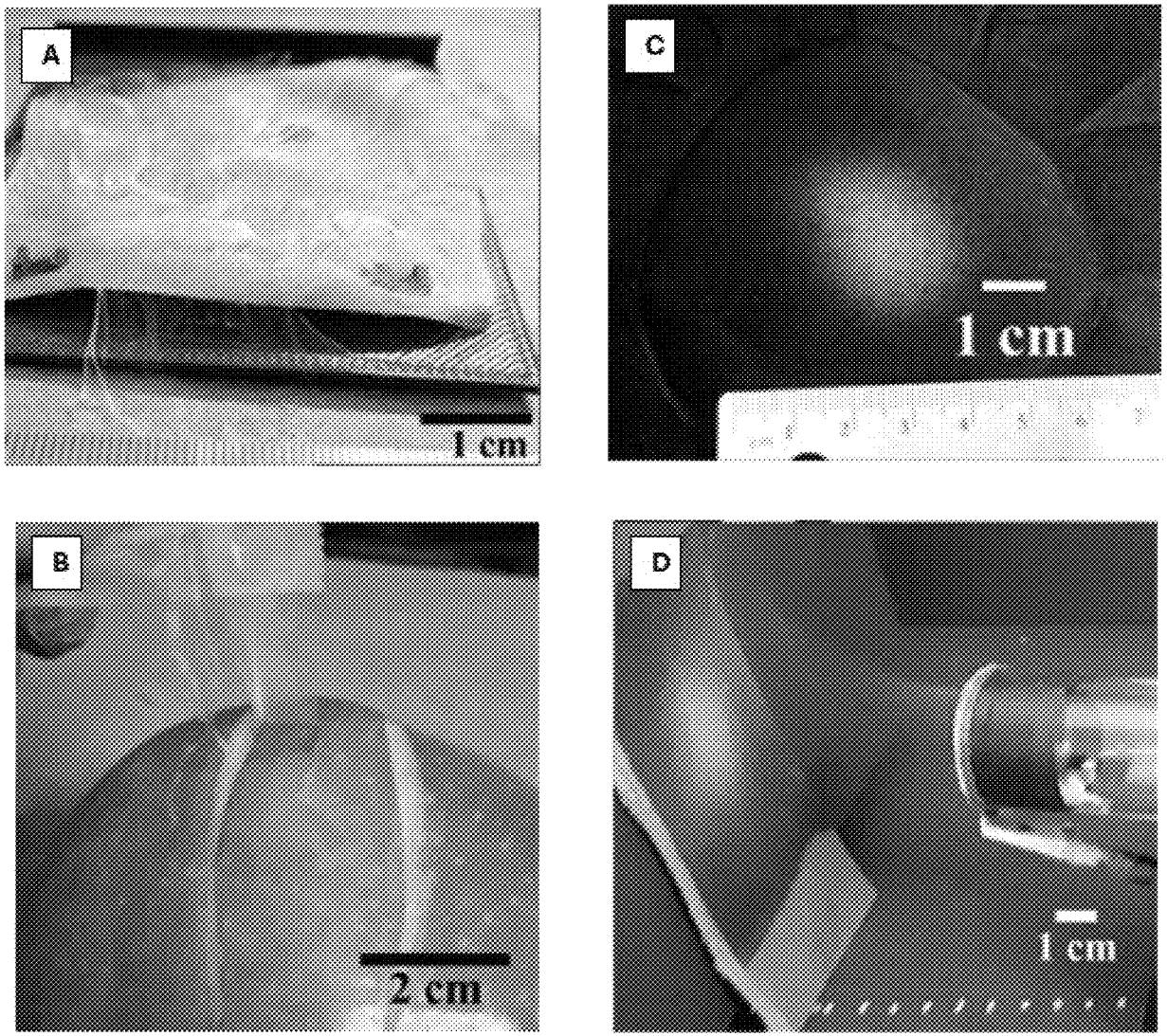
FIG. 3 A. Photo of electrospun fibers deposited by the portable ES device onto fetal porcine skin. B. Electrospun fibers deposited by the portable ES device onto an apple. C. Electrospun fibers deposited by the portable ES device onto fabric. D. Electrospun fibers deposited by the portable ES device onto dampened rawhide held at physiological temperature.

The ES device described herein does not require a charged or grounded surface behind the desired deposition surface or substrate 201. Using the portable ES device described herein, the substrate to be deposited onto is not placed within the electrostatic field during ES, nor is required to be supplied with a voltage or grounded in order for polymer to be deposited onto the surface. Examples of non-charged, non-grounded substrates used to demonstrate deposition with the portable ES device are pictured in FIG. 3. FIG. 3A is a photo of electrospun fibers deposited by the portable ES device onto fetal porcine skin. FIG. 3B is a photo of electrospun fibers deposited by the portable ES device onto an apple. FIG. 3C is a photo of electrospun fibers deposited by the portable ES device onto fabric. FIG. 3D is a photo of electrospun fibers deposited by the portable ES device onto dampened rawhide held at physiological temperature.

Figure 4:
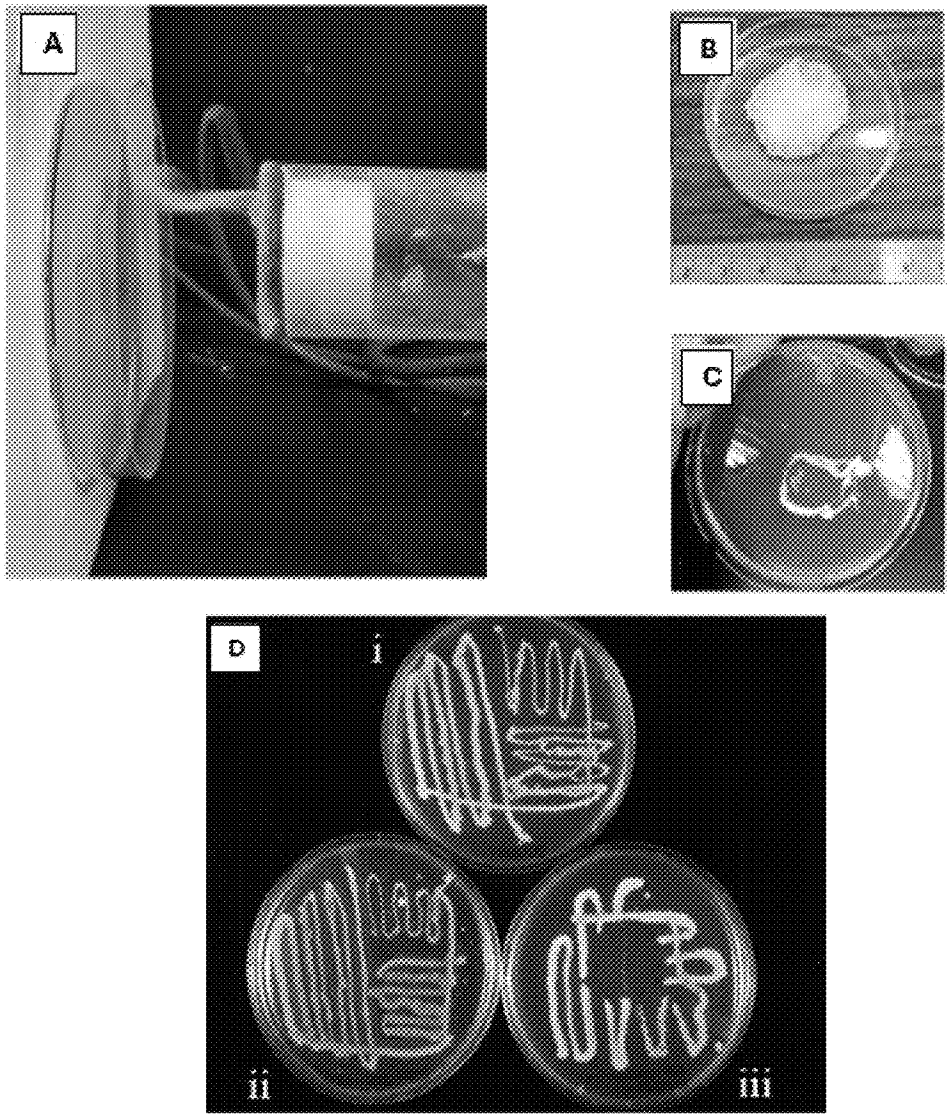
FIG. 4 A. Photo of portable ES device depositing antibiotic-containing polymer fibers directly onto a non-conductive agar plate. B. Antibiotic-containing polymer fiber mesh deposited onto a non-conductive substrate and peeled up before being placed in petri dish. C Antibiotic-containing fiber mesh from B after being dropped onto a bacterial plate and allowed to dissolve, thereby releasing the antibiotics. Di. Streak plate containing Staphylococcus aureus after overnight growth at 37° C., Dii. shows control streak plate from Di after being treated with a polymer-only electrospun mesh, and finally, Diii. shows a large bacterial death zone where antibiotic-containing electrospun fibers were deposited and dissolved to kill bacteria.

In the literature, there are many examples where traditional, tabletop ES fabrication was used to make biomedical materials. The portable ES device claimed here allows these materials to be deposited directly into wound sites, onto implants, and onto tissues or organs. Such uses of the device prevent contamination by handling and decrease time to treatment. By using antibiotic doped polymers the portable ES device can deposit onto non-conductive surfaces and dissolve to release antibiotics to prevent bacterial growth as shown in FIG. 4. FIG. 4A is a photo of portable ES device depositing antibiotic-containing polymer fibers directly onto a non-conductive agar plate. FIG. 5B is a photo of antibiotic-containing polymer fiber mesh deposited onto a non-conductive substrate and peeled up before being placed in petri dish. FIG. 4C is a photo of antibiotic-containing fiber mesh from B after being dropped onto a bacterial plate and allowed to dissolve, thereby releasing the antibiotics. FIG. Di is a photo of a streak plate containing Staphylococcus aureus after overnight growth at 37° C. FIG. Dii shows control streak plate from Di after being treated with a polymer-only electrospun mesh, and finally, FIG. Diii shows a large bacterial death zone where antibiotic-containing electrospun fibers were deposited and dissolved to kill bacteria.

Figure 5:
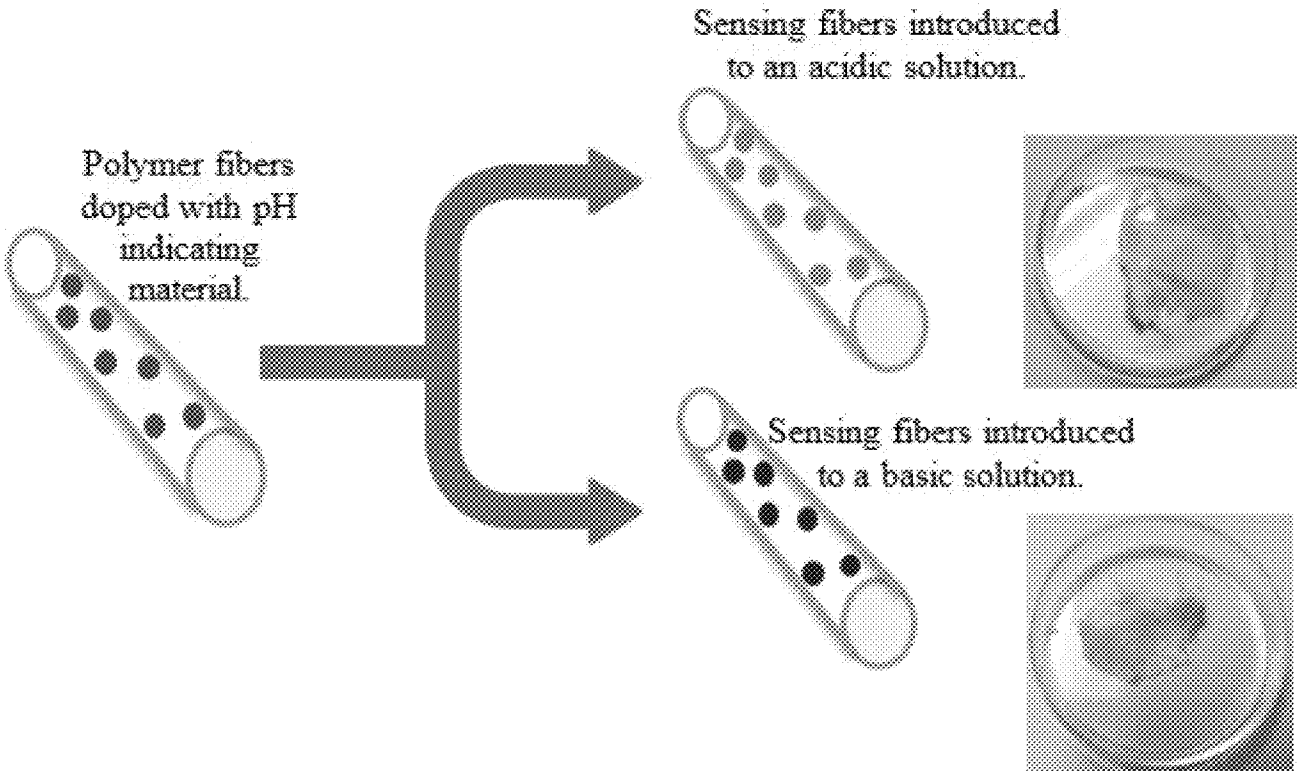
FIG. 5 Depiction of using the portable ES device to produced polymer fiber mats doped with commercial pH sensing compounds. In literature, it has been shown that pH change can indicate impending bacterial infection. The portable ES device allows direct deposition of pH sensing materials onto open wound sites. After deposition, color change could indicate an impending infection and deployment of preventative measures or early treatment could be employed to reduce severe side effects.

The portable ES device can also be used to deposit pH sensing materials for early detection of impending infection, which is depicted in FIG. 5. In literature, it has been shown that pH change can indicate impending bacterial infection. The portable ES device allows direct deposition of pH sensing materials onto open wound sites. After deposition, color change could indicate an impending infection and deployment of preventative measures or early treatment could be employed to reduce severe side effects.

Figure 6:
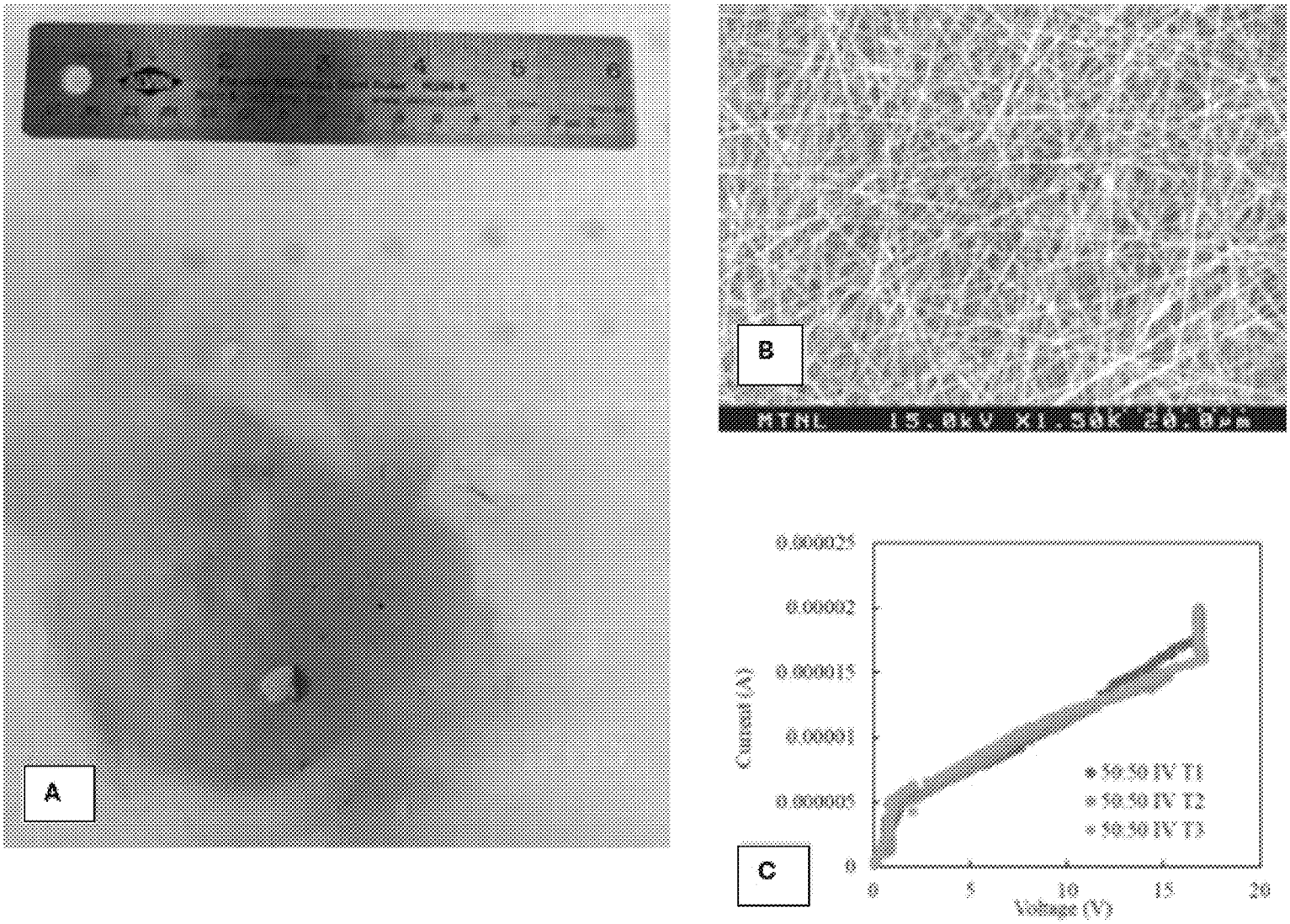
FIG. 6 A. Photo of electrospun mat produced by the portable ES device. The polymer used contained conductive dopants. B. Scanning electron micrograph showing the fiber morphology of the electrospun mat from A. C. Using a four-point probe, current was sourced through the conductive fiber mat and potential difference was measured. The resulting current-voltage (I-V) curves show that current indeed traveled through the fiber mat. Lack of electrical signals across the fiber mat would indicate non-conductivity. I-V characteristics are governed by Ohm's Law.

The portable ES device can also be used to produce electrospun mats with conductive dopants. FIG. 6A is a photo of an electrospun mat produced by the portable ES device. The polymer used contained conductive dopants. FIG. 6B is a scanning electron micrograph showing the fiber morphology of the electrospun mat from FIG. 6A. FIG. 6C shows using a four-point probe, current was sourced through the conductive fiber mat and potential difference was measured. The resulting current-voltage (I-V) curves show that current indeed traveled through the fiber mat. Lack of electrical signals across the fiber mat would indicate non-conductivity. I-V characteristics are governed by Ohm's Law.

Those skilled in the art will recognize many other applications of the portable ES device, where direct deposition of fibers onto charged or non-charged surfaces would be useful and such uses are contemplated within this disclosure.

Distinguishing capabilities of the portable ES device subject of this patent described herein include, but are not limited to the ability to deposit onto any conductive or non-conductive substrate, the ability to be moved by hand to coat complex surfaces evenly, and the ability electrospin conductive materials reliably. In a traditional ES unit, ES conductive polymers results in an electric circuit that connects the conductive spinneret, through the conductive polymer being electrospun, to the conductive deposition substrate. This connected electric circuit results in arcing and unpredictable material deposition. In the portable ES device claimed here, the electric field is completely encased in the device barrel and is not exposed to environmental factors. In addition, because conductive polymer fibers do not make contact with the ring electrode and are instead forced through the ring center by air and/or are isolated from the electrospun material by the device barrel, artifacts from a connected electrical circuit are prevented. Furthermore, the cross-flow embodiment reduces potential electrostatic field exposure of the surface or substrate receiving the deposition.

It is understood that the foregoing examples are merely illustrative of the present invention. Certain modifications of the articles and/or methods may be made and still achieve the objectives of the invention. Such modifications are contemplated as within the scope of the claimed invention.

What is claimed is:

1. A portable ES device comprising:

a device barrel, wherein said device barrel is comprised of a first end and a second end;

a spinneret encapsulated by said device barrel, wherein said spinneret is located in proximity to said first end of said device barrel;

a conductive electrode located in proximity to said second end of said device barrel, wherein an electrostatic field is produced between said spinneret and said conductive electrode; and a crossflow system comprised of a first perpendicular opening of said device barrel, where an air flow stream, directs electrospun material from said spinneret to a surface or substrate through a second perpendicular opening of said device barrel.

2. The portable ES device of claim 1, wherein said conductive electrode is located on the outside of said device barrel to isolate said conductive electrode from electrospun material.

3. The portable ES device of claim 1, wherein said conductive electrode is comprised of a ring electrode.

4. The portable ES device of claim 1, wherein said surface or substrate is ungrounded.

5. The portable ES device of claim 1, wherein said spinneret is connected to a high voltage source.

6. The portable ES device of claim 1, wherein said spinneret is grounded.

7. The portable ES device of claim 1, wherein said conductive electrode is connected to a high voltage source.

8. The portable ES device of claim 1, wherein said conductive electrode is grounded.

9. The portable ES device of claim 1, further comprising mechanically-powered means to deliver polymer to said spinneret.

10. The portable ES device of claim 1, wherein said mechanically-powered means is comprised of a pump.

11. The portable ES device of claim 1, further comprising a thermal system comprising of a controller and heating means to melt solid polymer prior to delivery to said spinneret.

12. The portable ES device of claim 1, further comprising a power supply means used to supply the system with high voltage, wherein said power supply means comprises a EMCO CB 101 device that converts low DC voltage to high DC, a 12 V battery, and a 5V signal controller to vary potential output.

13. The portable ES device of claim 1, wherein said barrel and said airflow means are further comprised of quick connect components to allow for easy connection and disconnection.

14. The portable ES device of claim 1, wherein said second perpendicular opening is selectively fitted with a perpendicular barrel.

15. A method of depositing electrospun materials on a surface or substrate comprising:

a. providing the portable ES device of claim 1;

b. electrospinning a material wherein said material is drawn from said spinneret in the direction of said conductive electrode, and c. depositing said material onto said surface or substrate, wherein said material is directed to said surface or substrate by said airflow stream.

16. The method of depositing electrospun materials on a substrate or surface of claim 15, wherein said second perpendicular opening is selectively fitted with a perpendicular barrel.

17. The method of depositing electrospun materials on a surface or substrate of claim 15, wherein said material is comprised of antibiotic-containing polymer fibers.

18. The method of depositing electrospun materials on a surface or substrate of claim 15, wherein said material is comprised of antibiotic-containing fiber mesh.

19. The method of depositing electrospun materials on a surface or substrate of claim 15, wherein said material is comprised of pH sensing materials.

20. The method of depositing electrospun materials on a surface or substrate of claim 15, wherein said material is comprised of polymer containing conductive dopants.

* * * * *